US006913568B2

(12) United States Patent
Frank et al.

(10) Patent No.: US 6,913,568 B2
(45) Date of Patent: Jul. 5, 2005

(54) APPARATUS FOR REMOVING AND ERECTING A FOLDING-BOX BLANK

(75) Inventors: Alexander Frank, Schaffhausen (CH); Walter Rühli, Schaffhausen (CH); Peter Meyer, Beringen (CH)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 10/712,314

(22) Filed: Nov. 13, 2003

(65) Prior Publication Data

US 2004/0110619 A1 Jun. 10, 2004

(30) Foreign Application Priority Data

Dec. 6, 2002 (CH) ..... 2079/02

(51) Int. Cl.[7] ..... B31B 01/78

(52) U.S. Cl. ..... 493/309; 493/313; 493/315; 493/316

(58) Field of Search ..... 493/309, 310, 493/313, 314, 315, 316, 317, 318

(56) References Cited

U.S. PATENT DOCUMENTS 4,537,587 A * 8/1985 Langen ..... 493/315
5,207,630 A * 5/1993 Decker et al. ..... 493/313
5,411,464 A * 5/1995 Calvert et al. ..... 493/315
5,415,615 A * 5/1995 Culpepper ..... 493/315
5,473,868 A * 12/1995 Antonio ..... 53/566
5,561,968 A * 10/1996 Palmer ..... 53/458
6,050,063 A * 4/2000 Ford et al. ..... 53/458

FOREIGN PATENT DOCUMENTS

| | | |
|---|---|---|
| DE | 2937129 | 3/1980 |
| DE | 3930720 | 5/1990 |
| DE | 3941866 | 6/1991 |
| EP | 0182967 | 7/1985 |
| EP | 0434961 | 11/1990 |
| EP | 0440940 | 12/1990 |

* cited by examiner

*Primary Examiner*—Sameh H. Tawfik
(74) *Attorney, Agent, or Firm*—Harness, Dickey & Pierce, P.L.C.

(57) ABSTRACT

An apparatus for removing a folding-box blank (Z) from a magazine and for erecting the same has a first retaining means (6) with means (62) for gripping a first box wall (W1) of the blank (Z) and a second retaining means (7) with means (72) for gripping a second, adjacent box wall (W2) located on the same side of the blank (Z). The two retaining means (6, 7) can be moved relative to one another in order to erect the box. This allows the folding-box blank to be removed and erected in a space-saving and efficient manner.

10 Claims, 4 Drawing Sheets

APPARATUS FOR REMOVING AND ERECTING A FOLDING-BOX BLANK

TECHNICAL FIELD

The invention relates to an apparatus and to a process for removing a folding-box blank from a magazine and for erecting the same.

BACKGROUND OF THE INVENTION

An apparatus of the generic type is known from EP-A-0,182,967. This apparatus has a gripping arm which has suction grippers and by means of which a folding-box blank is removed from a magazine. The gripping arm is then pivoted and displaced in a translatory manner in order to move the blank to a stationary abutment, which likewise has suction grippers. As soon as the abutment has gripped the rear side of the blank, the gripping arm is pivoted away again, with the result that the box is erected.

DE-A-29,37,129 discloses a further carton-erecting means. This carton-erecting means has a removal unit which can be displaced perpendicularly to the magazine stack and has suction grippers for gripping a carton blank. When the blank is removed, it is opened slightly by a tongue-like element. The carton is then opened further, and erected, during continued lowering movement of the removal unit, by way of a two-legged supporting element, the legs of which can be changed in respect of their angle in relation to one another by means of compressed air.

Further erecting apparatuses are known from DE-A-39,30,720, EP-A-0,434,961, DE-A-39,41,866 and EP-A-0,440,940. These apparatuses have multi-armed star-shaped rotors, of which the arms are provided with suction grippers. In each case one arm removes a blank from the magazine stack, by attaching a first box wall by suction, and transports the latter over a circular path. During the transportation, a lever arm which is arranged laterally on the arm is then actuated, the lever arm pressing on a second box wall, which is adjacent to the first box wall, and thus erecting the box.

The known apparatuses have the disadvantage that they take up a relatively large amount of space. In addition, they require a relatively long period of time for the removal and erecting operations, because the blank has to be transported away from the magazine before it can be erected.

SUMMARY OF THE INVENTION

It is therefore an object of the invention to provide an apparatus and a process which are intended for removing a folded-box blank from a magazine and for erecting the same and which eliminate the abovementioned disadvantages.

This object is achieved by an apparatus having a first retaining means for removing the folding-box blank and a second retaining means for erecting the folding-box blank by virtue of the second retaining means being moved relative to the first retaining means, the first retaining means having means for gripping a first box wall and the second retaining means having means for gripping a second box wall, which is adjacent to the first box wall, wherein the first and second retaining means can be arranged such that they grip box walls located on the same side of the folding-box blank.

This object is further achieved by a process for removing a folding-box blank from a magazine and for erecting the same, comprising the steps of removing the folding-box blank by a first retaining means and erecting the folding-box blank by virtue of a second retaining means, wherein moved relative to the first retaining means, the first retaining means grips a first box wall and the second retaining means grips a second box wall, which is adjacent to the first box wall, wherein the first and the second retaining means grip the box walls on the same side as the folding-box blank.

It is thus also possible for the second box wall to be gripped at a relatively early point in time, preferably even during removal from a magazine stack. The box can be erected relatively soon after the removal operation. Since the folding-box blank removed need not first be moved to an erecting location, time and space are saved.

It is advantageous that the folding box does not have to be released from the point in time of removal from the magazine until the box is adhesively bonded. Furthermore, it is advantageous that two box walls can be gripped during removal from the magazine. The box blank is thus retained in a more reliable manner. A further advantage is that it is possible for different folding-box formats to be gripped, and erected, with the retaining means unchanged, as a result of which format-changeover parts are dispensed with.

In a preferred embodiment, the two retaining means can be moved both with one another and in relation to one another, these movements preferably being executed, at least in part, simultaneously. It is preferably possible for them to be swung relative to one another through a swing-action angle, jointly pivoted and jointly displaced in a translatory manner. If at least the pivoting and swing-action movements are executed, at least in part, simultaneously, then the operation of erecting the box can begin even during removal of the blank.

Further advantageous embodiments can be gathered from the dependent patent claims.

BRIEF DESCRIPTION OF THE DRAWING

The subject matter of the invention will be explained hereinbelow with reference to a preferred exemplary embodiment which is illustrated in the attached drawing, in which.

PREFERRED EMBODIMENTS

Figure 1:
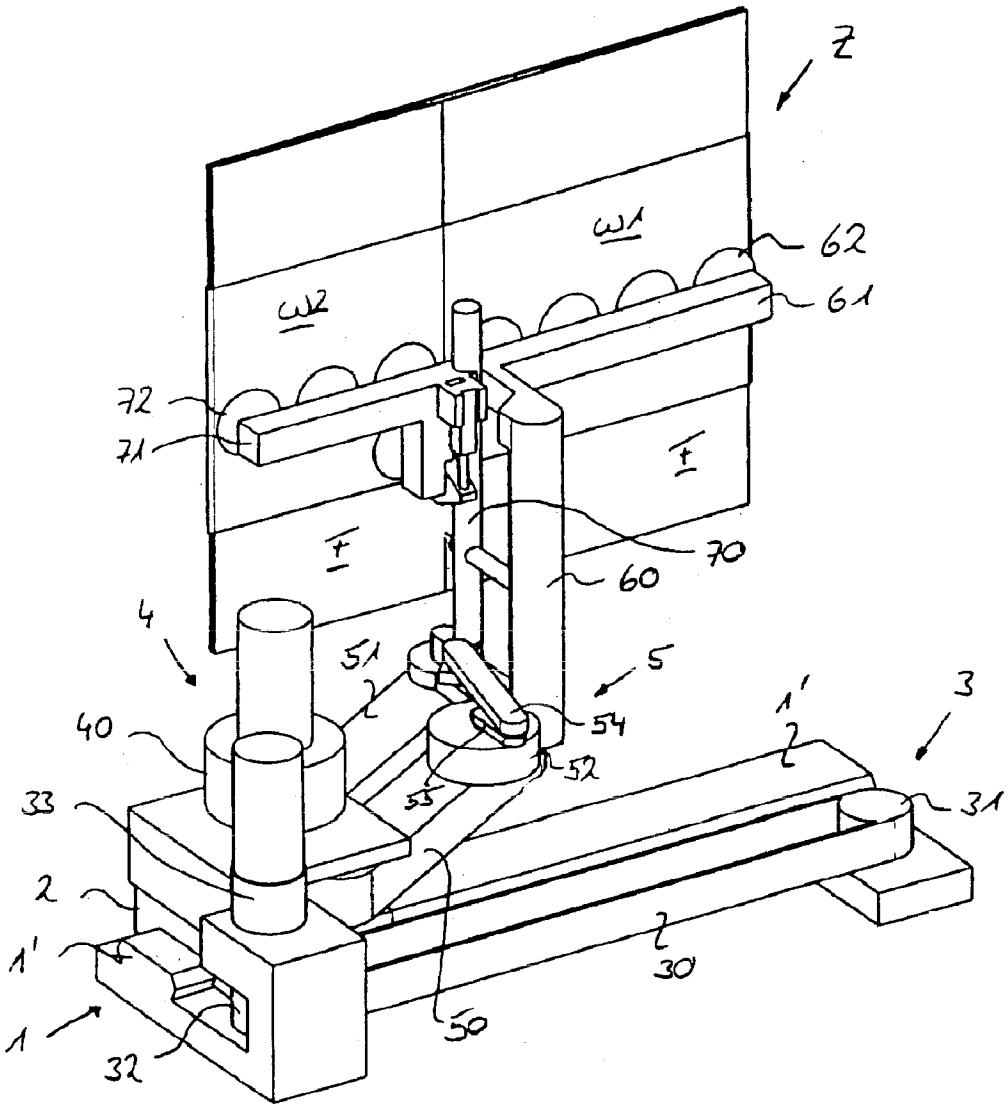
FIG. 1 shows a perspective illustration of the apparatus according to the invention during removal of a folding-box blank.

FIG. 1 illustrates an apparatus according to the invention. The apparatus has a base 1 with a guide track 1'. A carriage or sled 2 is arranged on the guide track 1' such that it can be displaced in a translatory manner. The translatory drive means 3 provided here is a belt drive with a belt 30 which runs parallel to the guide track 1' and on which the carriage 2 is fastened. The belt 30 runs around a deflecting roller 31 and a drive roller 32, the latter being driven by means of a first motor 33.

A parallelogram linkage 5 is arranged in a pivotable manner on the carriage 2. Its pivot axis here preferably runs perpendicularly to the plane of the guide track 1'. A pivoting-drive means 4 with a second motor 40 has been provided for this purpose, said motor transmitting a pivoting movement to a first end of the parallelogram linkage 5, this end being arranged on the carriage 2.

Arranged at a second, free end of the parallelogram linkage 5, on in each case one rod or bar 50, 51 in the parallelogram 5, is a retaining means 6, 7. The retaining means 6, 7 each have a spindle 60, 70 running perpendicularly to the parallelogram 5. Arranged at the top end of each spindle 60, 70, said end being directed away from the parallelogram 5, is a carrier bar 61, 71, which runs transversely to the spindle. Suction grippers 62, 72 are fastened on the carrier bars 61, 71 in order to grip a folding-box blank Z.

Also arranged on the parallelogram linkage 5 is a swing-action drive means 5', in order that the two retaining means 6, 7 can be swung relative to one another. For this purpose, a crank drive 52 with a crank 53 is provided on the first bar 50, on which the first retaining means 6 is arranged. The crank drive 52 is preferably pneumatic. A connecting rod 54 is fastened on the crank 53 and is connected, via a connecting crosspiece 55, to the second retaining means 7, and more specifically to the second spindle 70. It is thus possible for the second spindle 70 and thus the second carrier bar 71 to be swung in relation to the first retaining means 6. The swing-action angle is usually 90°. However, it depends on the shape of the box erected.

FIG. 1 illustrates how the folding-box blank Z is removed from a magazine stack. For this purpose, the first and second retaining means 6, 7 are pivoted in the direction of the magazine stack by means of the parallelogram 5 or the pivoting-drive means 4. The retaining means 6, 7, which in this state are aligned along a single line, grip two preferably adjacent box walls W1, W2, which are located on the same side of the blank Z. In the example illustrated here, the second retaining means 7 also already grips its box wall W2 at this point. However, it is also possible for it only to be moved, in particular pivoted, into this position following removal.

Figure 2:
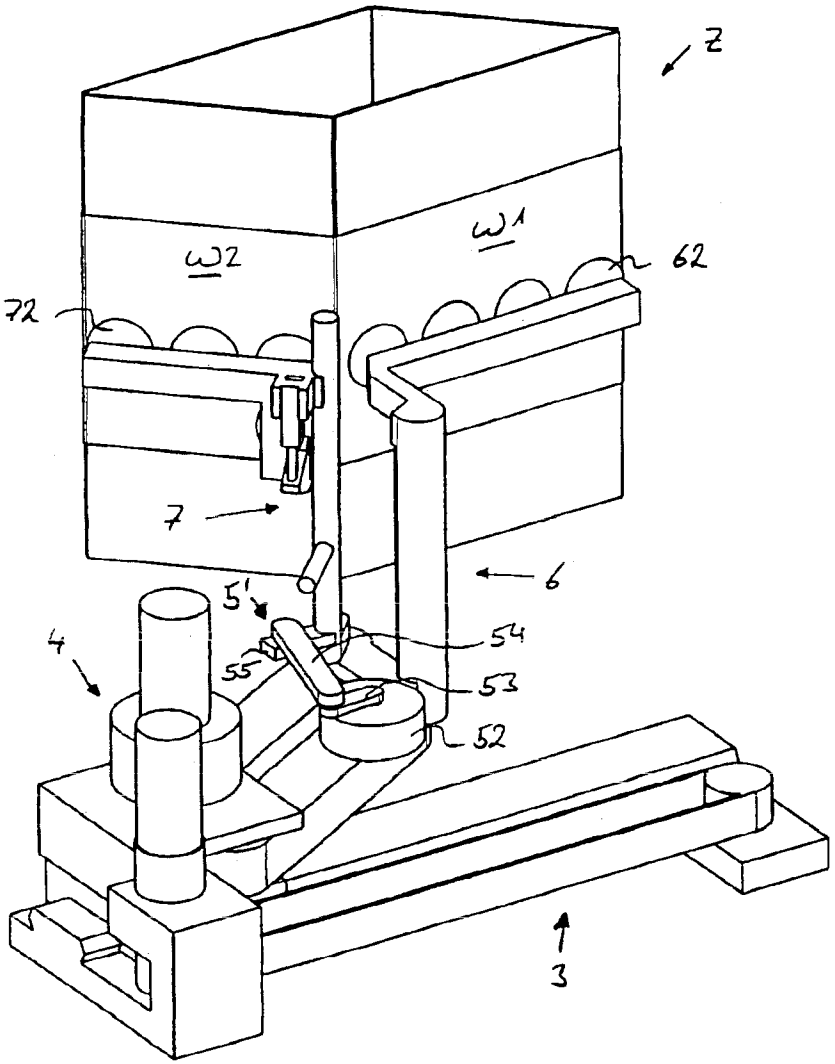
FIG. 2 shows the apparatus according to FIG. 1 at a subsequent point in time.

As can be seen in FIG. 2, the retaining means 6, 7 are moved away from the stack by virtue of the parallelogram 5 being pivoted. It is preferable here to begin the swing-action movement as soon as sufficient space is available. In the state illustrated, the second retaining means 7 has thus already been swung to a slight extent in the direction of the first retaining means 6. In order that the box walls of the collapsed blank Z actually separate, an opening means 10 is preferably provided. This can best be seen in FIGS. 3 and 4. It preferably comprises a tongue or a rod which engages through between the folding tabs F of the adjacent box walls W1, W2 even during removal and is preferably immediately drawn back again. It is also possible, for example, for an air nozzle to be used as the opening means 10.

Figure 3:
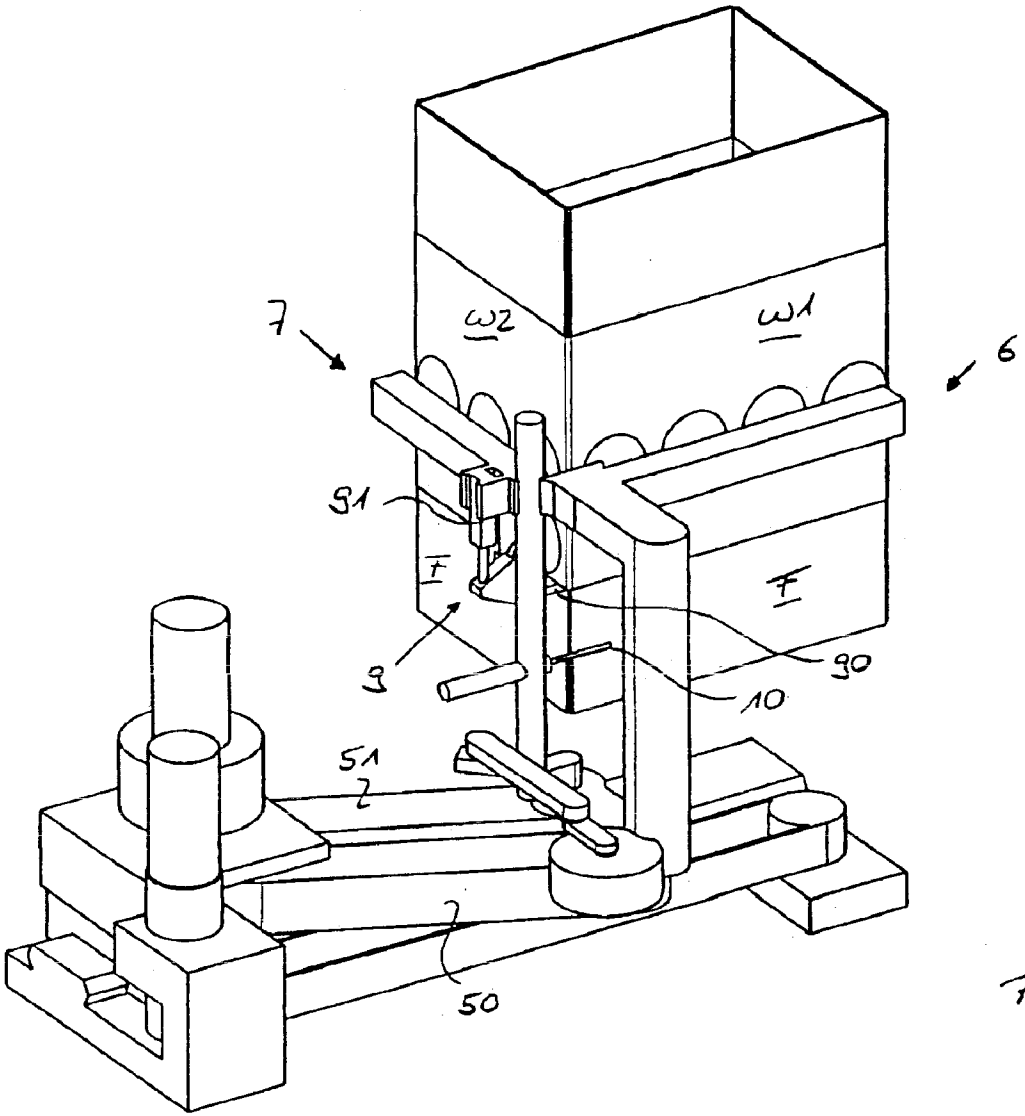
FIG. 3 shows the apparatus according to FIG. 1 with the box partly erected.

In the state according to FIG. 3, the second retaining means 7 has reached the predetermined swing-action angle of 90° and the box is now partly erected. As can be seen in FIGS. 2 and 3, the first retaining means 6 or its carrier bar 61 preferably maintains its orientation relative to the stack of the magazine during the pivoting movement of the parallelogram 5, with the result that the bar 61 is drawn away perpendicularly from the stack surface during the pivoting movement and in the longitudinal direction in relation to the same during the translatory movement.

Figure 4:
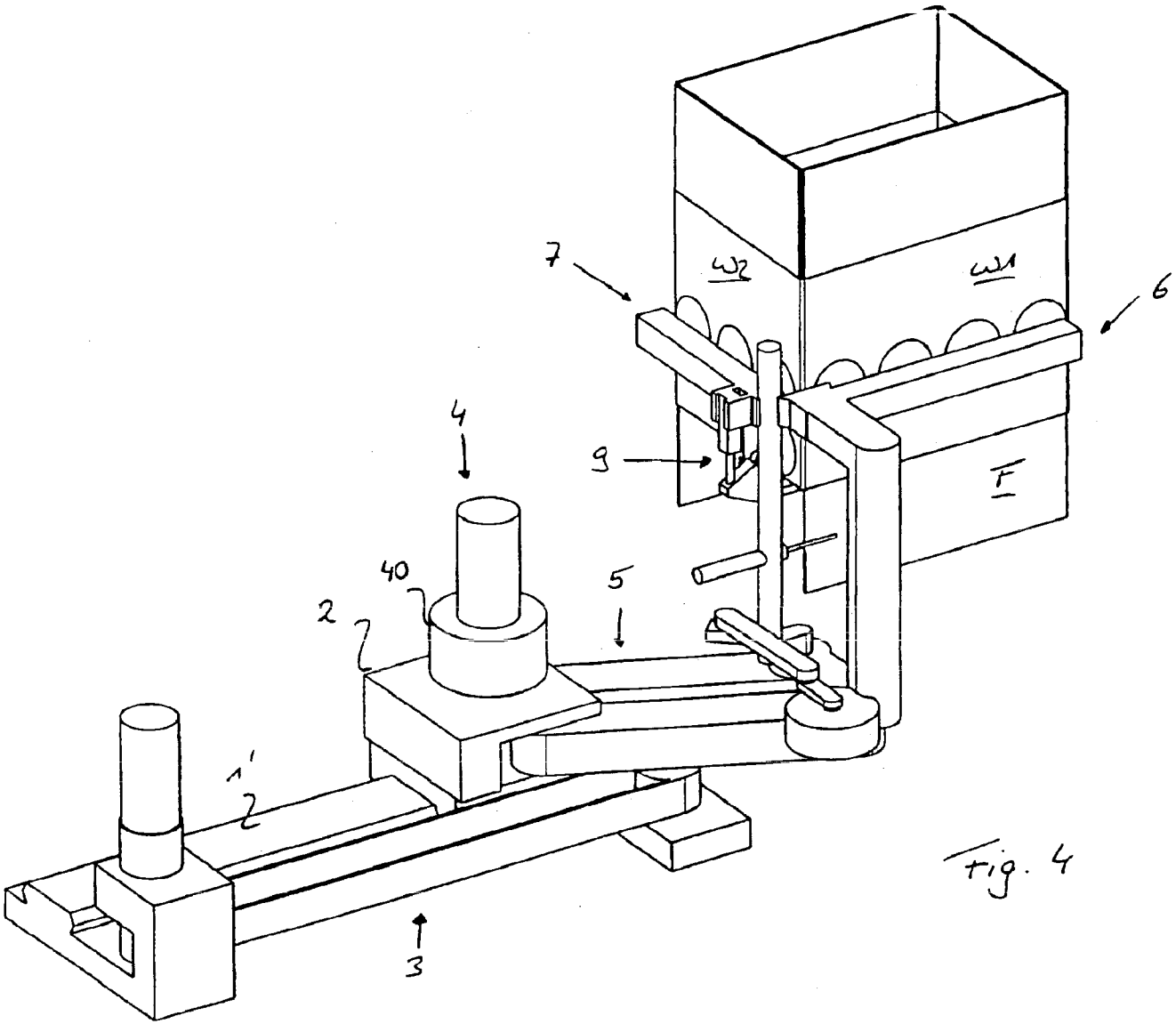
FIG. 4 shows the apparatus according to FIG. 1 during the operation of swinging in a folding tab.

In FIG. 4, the first and second retaining means 6, 7 have now been transported in a translatory manner, by means of the carriage 2, to a transfer location for the box. During this transportation, the rear folding tab F, which is remote from the transfer location, is folded in by a folding-in means 9. The folding-in means 9 is preferably arranged on the second retaining means 7, and more specifically on the second carrier bar 71. It has a folding-in bar 90, which can preferably be actuated by means of a pneumatic pressure cylinder 91. The folding-in bar 90 forces the folding tab F upward and remains in this position until the box is transferred, at the transfer location, to a following station. The rest of the folding tabs are usually swung round by known means, for example lateral and front guides, before the transfer. Once the box has been transferred, the apparatus can be moved back again into the starting position according to FIG. 1.

The above described movement sequence may be modified. Individual movements may be executed one after the other or simultaneously. The translatory movement may also be combined, for example, with the swing-action and pivoting movements. It is also possible to use other movement means instead of the carriage and the parallelogram. Suitable drive means, in particular, are servomotors, pneumatic drives or three-phase alternating-current motors.

The apparatus according to the invention has two retaining means which can be moved in relation to one another and are intended for gripping two box walls located on the same side. This allows the folding-box blank to be removed and erected in a space-saving and efficient manner.

Reference Numbers

Z Folding-box blank
F Folding tab
W1 First box wall
W2 Second box wall
1 Base
1' Guide track
2 Carriage
3 Translatory drive means
30 Belt
31 Deflecting roller
32 Drive roller
33 First motor
4 Pivoting-drive means
40 Second motor
5 Parallelogram linkage
5' Swing-action drive means
50 First bar
51 Second bar
52 Crank drive
53 Crank
54 Connecting rod
55 Connecting crosspiece
6 First retaining means
60 First spindle
61 First carrier bar
62 First suction gripper
7 Second retaining means
70 Second spindle
71 Second carrier bar
72 Second suction gripper
9 Folding-in means
90 Folding-in bar
91 Pressure cylinder
10 Opening means The entire disclosure of Switzerland Patent Application No. 2002 2079/02 filed Dec. 6, 2002 is hereby incorporated by reference.

What is claimed is:

1. An apparatus for removing a folding-box blank from a magazine and for erecting the same, the apparatus having a first retaining means for removing the folding-box blank and a second retaining means for erecting the folding-box blank by virtue of the second retaining means being moved relative to the first retaining means, the first retaining means having means for gripping a first box wall and the second retaining means having means for gripping a second box wall, which is adjacent to the first box wall and which is located on the same side of the folding-box blank as the first box wall and which is swung relative to the first box wall into a partly erected state of the box, the second box wall and the first box wall being arranged in said partly erected state at an angle of approximately 90° to each other.

2. The apparatus as claimed in claim 1, wherein the first and the second retaining means can be moved with one another and in relation to one another.

3. The apparatus as claimed in claim 1, wherein the first retaining means can be swung through a swing-action angle relative to the second retaining means, the swing-action angle preferably being at least more or less 90°.

4. The apparatus as claimed in claim 1, wherein the first and the second retaining means can be jointly pivoted.

5. The apparatus as claimed in claim 4, wherein the first and the second retaining means are arranged on a pivotable parallelogram linkage.

6. The apparatus as claimed in claim 1, wherein the apparatus comprises a base and wherein the first and the second retaining means can be jointly and transversely displaced relative to said base.

7. The apparatus as claimed in claim 6, wherein a carriage is arranged to be displaceable on said base and wherein the first and the second retaining means are arranged on said carriage.

8. The apparatus as claimed in claim 1, wherein the means for gripping the box walls are suction grippers.

9. The apparatus as claimed in claim 8, wherein the suction grippers are arranged on carrier bars, which are connected to pivotable spindles of the retaining means.

10. The apparatus as claimed in claim 1, wherein there is provided an opening means, which projects through between folding tabs of the two adjacent box walls.

* * * * *